United States Patent [19]

Bartolf

[11] Patent Number: 4,475,782

[45] Date of Patent: Oct. 9, 1984

[54] ELECTRICAL CONNECTOR APPARATUS

[75] Inventor: George Bartolf, Brick Town, N.J.

[73] Assignee: Buck Engineering Co., Inc., Farmingdale, N.J.

[21] Appl. No.: 337,595

[22] Filed: Jan. 7, 1982

[51] Int. Cl.[3] ..... H01R 11/22

[52] U.S. Cl. ..... 339/18 B; 339/256 S

[58] Field of Search ..... 339/254 M, 256 S, 253 S, 339/18 R, 18 B, 252 S, 252 R

[56] References Cited

U.S. PATENT DOCUMENTS

| | | | |
|---|---|---|---|
| 1,152,705 | 9/1915 | Churchill | 339/254 R |
| 2,456,302 | 12/1948 | Mocnik | 248/303 |
| 3,066,274 | 11/1962 | Ellis | 339/97 |
| 3,085,177 | 4/1963 | Thompson | 339/18 R |
| 3,179,913 | 4/1965 | Miller et al. | 339/18 |
| 3,235,830 | 2/1966 | Newton | 339/18 |
| 3,317,885 | 5/1967 | Yost | 339/256 S |
| 3,341,806 | 9/1967 | Joachim | 339/192 |
| 3,382,479 | 5/1968 | Cooney | 339/256 S |
| 3,383,647 | 5/1968 | Duffield et al. | 339/256 |
| 3,418,621 | 12/1968 | Campbell | 339/18 |
| 3,513,434 | 5/1970 | Zielke | 339/18 |
| 3,597,722 | 8/1971 | Walter | 339/19 |
| 3,681,744 | 8/1972 | Olsson | 339/256 R |
| 3,825,670 | 7/1074 | Katz et al. | 174/73 |
| 3,883,207 | 5/1975 | Tomkiewicz | 339/75 M |
| 3,912,351 | 10/1975 | Glage et al. | 339/48 |

FOREIGN PATENT DOCUMENTS

| | | | |
|---|---|---|---|
| 866360 | 2/1953 | Fed. Rep. of Germany | 339/252 R |
| 997233 | 9/1951 | France | 339/256 S |
| 29822 | 12/1914 | United Kingdom | 339/256 S |
| 221872 | 9/1924 | United Kingdom | 339/254 M |
| 1542102 | 3/1979 | United Kingdom | 339/252 R |

*Primary Examiner*—John McQuade
*Assistant Examiner*—Paula Austin
*Attorney, Agent, or Firm*—Parmelee, Bollinger & Bramblett

[57] ABSTRACT

A plug-board type apparatus permits the interconnection of electrical conductors and components having conductive leads as an aid in the instruction of students in electricity and electronics. A panel of insulating material has a plurality of openings to receive the leads. A plurality of cavities are positioned opposite the openings, each of the cavities being accessible to leads through a different set of the openings. A pair of coiled contact springs are positioned in each cavity to receive and hold therebetween electrical leads which are inserted through the openings.

3 Claims, 5 Drawing Figures

ELECTRICAL CONNECTOR APPARATUS

BACKGROUND OF THE INVENTION

This invention relates to an electrical connector apparatus for the interconnection of electrical components of the same or different types having single, multiple, similar or different sized conductor connections which may be plugged in and removed conveniently and reliably without requiring special sockets, couplers or solder for making the required electrical connections.

A large variety of electrical connector terminals have been provided for interconnecting electrical components and forming electrical circuits. Many such connectors are elaborate, expensive or special purpose arrangements and are not suitable for instructional purposes which application requires convenience, reliability, flexibility and which will accommodate the rapid connection and disconnection of a variety of different types of components having the same or different sized electrical connectors. Since the time element and reuse are essential, special connectors as well as solder type connections are simply not suitable.

SUMMARY OF THE INVENTION

Accordingly, it is an object of this invention to provide an improved electrical connector apparatus of the type which can accommodate an unusually wide size of electrical conductor configurations of relatively low cost, without degrading connections so made while maintaining a nearly constant force on the conductors thereby creating minimal conductor degradation and maintaining low electrical contact resistance after repeated insertions.

A further object of this invention is to provide a new and improved electrical connector apparatus for interconnecting multiple components in which the conductive contact for the components is made through openings in an insulated work surface to provide free access to the connections while properly insulating the student from electrical conductive surfaces.

A further object of this invention is to provide a new and improved electrical connector apparatus which permits the interconnection of a variety of electrical components such as transistors, rectifiers, special transformers which may have individual bases utilizing numerous or different types of contact pins.

Still a further object of this invention is to provide a new and improved electrical connector apparatus which is convenient, reliable, flexible and continually reusable.

Still a further object of this invention is to provide a new and improved electrical connector apparatus which maintains the holding forces for plug-in type connections of varying sized conductors and provides a minimal insertion resistance on the conductors where electrical contact is made.

In carrying out this invention, in one illustrative embodiment thereof, an electrical connector apparatus is provided for making interconnections between the same and different types of electrical components having single, multiple, similar or different sized conductor connections utilizing a panel of insulating material having a plurality of openings therein which are adapted to receive the electrical conductors. A plurality of cavities are positioned on the panel opposite the openings, each of which is accessible to the electrical conductors through a different set of the openings. Each of the cavities have adjacent coiled contact springs positioned therein which are adapted to receive and hold electrical conductors inserted into the cavities through the openings with the electrical conductors being held in frictional engagement with the springs, the deflection of which is determined by the size of the electrical conductors positioned therebetween.

The openings may be arranged in groups and rows on the panel board with the cavities being arranged in corresponding rows. Components are interconnected by having one or more conductors thereof inserted into openings in the same cavity. Each of the cavities also contains expansion baffles along adjacent sides thereof which limit the lateral expansion of the contact springs to an area immediately adjacent the inserted component. The size of the component conductor will determine the amount of spring contact deflection. The maximum spring deflection, as well as the size of the conductor which can be accommodated is limited by the size of the openings through the insulated flat work surface of the panel, and contact wear is controlled by the specific dimension of the baffles in the cavities.

BRIEF DESCRIPTION OF THE DRAWINGS

The invention, together with further objects, advantages, features and aspects thereof will be more clearly understood from the following description taken in conjunction with the accompanying drawings in which like elements bear the same reference numerals.

DESCRIPTION OF THE PREFERRED EMBODIMENTS

Figure 1:
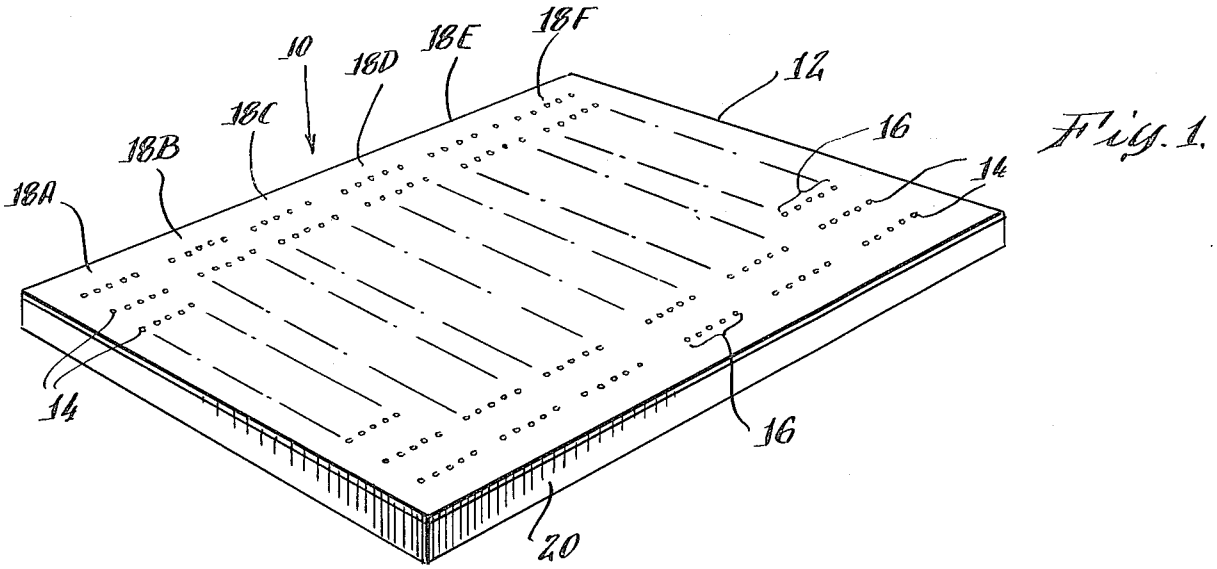
FIG. 1 is a perspective view of the electrical contactor assembly embodying the present invention.

Referring now to FIG. 1, an electrical connector apparatus referred to generally with the reference numeral 10, has a front panel 12 having a plurality of openings 14 which are arranged in groups 16 and rows 18*a–f*. The front panel 12 is mounted on a hollow base 20. The front panel 12 may be either of opaque of transparent electrical insulating material which isolates the electrical connecting mechanisms which will be described hereinafter from the user of the apparatus.

Figure 2:
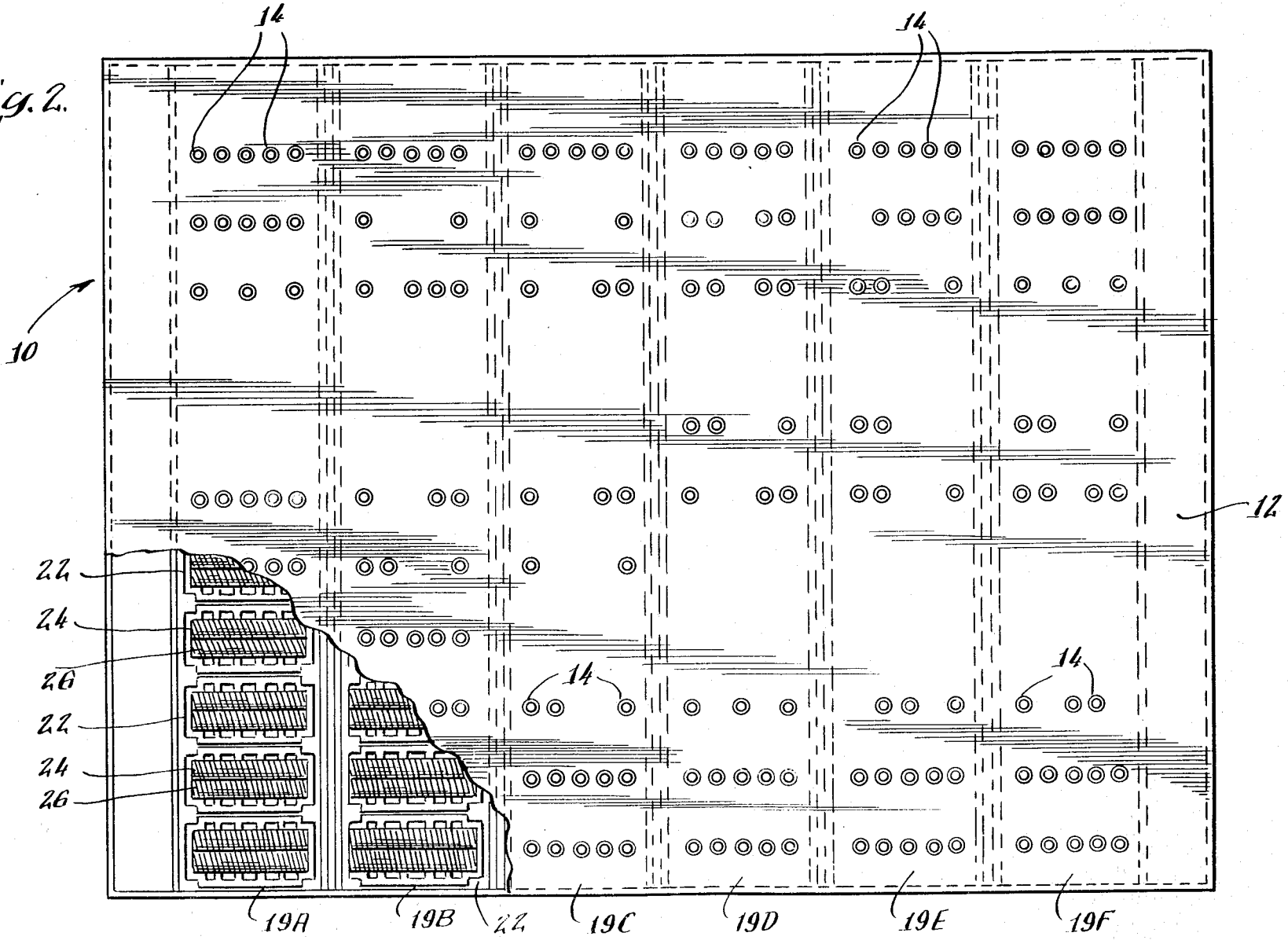
FIG. 2 is a top view, partly broken away, of the electrical connector apparatus shown in FIG. 1.
Figure 4:
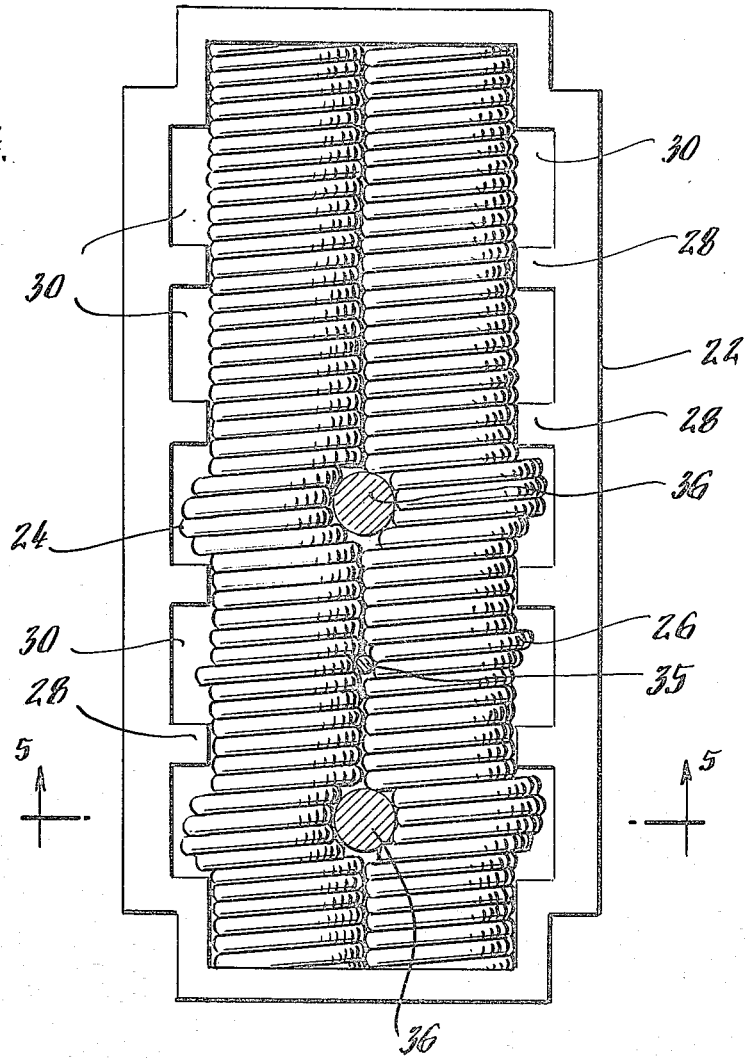
FIG. 4 is an enlarged top view of an individual cavity illustrating different sized conductors positioned therein.
Figure 5:
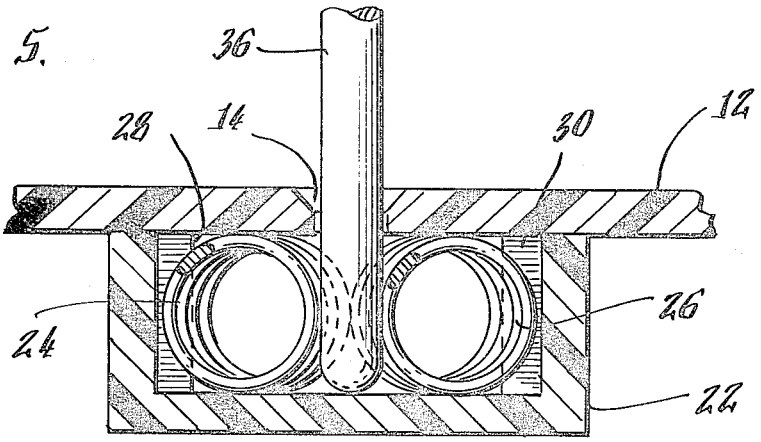
FIG. 5 is a cross-sectional view taken along line 5—5 of FIG. 4.

As will be seen in FIG. 2, a plurality of contact cavities 22 are positioned opposite each group of openings 14 and are arranged in rows 19*a*, 19*b*, 19*c*, etc. Each row 19*a–f* contains a group of contact cavities 22 which are aligned with, and access gained through, the multiplicity of openings 14 in the front panel 12. As will best be seen in FIGS. 4 and 5, the cavities 22, which may be molded and are made of insulating material, contain contact springs 24 and 26 placed longitudinally adjacent and parallel to each other within the cavity 22. The contact cavity 22 contains a plurality of spring expansion baffles 28 which define a plurality of expansion areas 30 within the contact cavity 22. The spring extension baffles 28 limit the lateral expansion of the contact springs 24 and 26 to the areas immediately adjacent the point where the inserted component conductor has been inserted. In FIG. 4 conductors 35 and 36 having different external diameters illustrate this point. The openings 14 arranged in groups 16 are aligned on the front panel 12 over the contact cavities 30 such that the openings overlie the areas 30 delineated by the spring expansion baffles 28 and are aligned such that the insertion of a component conductor such as 35 or 36 into an opening 14 in the front panel 12 pushes such a conductor 35 or 36 between the two springs 24 and 26 separating them in the manner shown. The size of the component conductor 35 or 36 determines the amount of parallel contact spring deflection illustrated by the component conductors 35 and 36 in FIG. 4. The maximum parallel contact spring deflection is limited by the size of the openings 14 or the area 30 and the contact wear is controlled by the dimension of the cavity baffles 28.

The size of the cavity 22 as well as the openings 14 in the front panel may be varied and may contain different sizes in different rows. As an illustrative example, the contact springs 24 and 26 may be approximately 1.35 inches long, have diameters of 0.24 inches, and be made of nickel plated 0.022 inch diameter music wire. The spring is formed in a right hand helix having approximately 62 coil turns without end loops.

The two coil springs 24 and 26 when placed adjacent in a contact cavity 22 form an electrical conducting surface capable of providing a holding force for electrical components sufficient to maintain a contact resistance of less than 0.1 ohm. The spring diameter and material are selected to optimize contact resistance, insertion force, holding force, and long term reliability characteristics.

Figure 3:
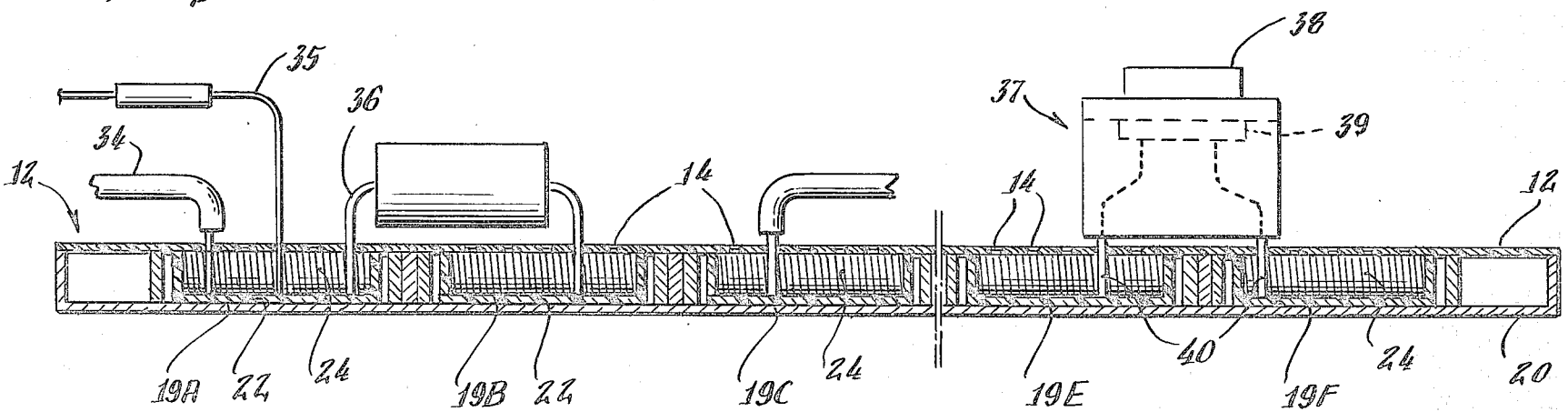
FIG. 3 is a cross-sectional view of the electrical connector apparatus illustrated in FIG. 1 showing a variety of different electrical components and different sized conductors being interconnected on the electrical connector apparatus.

FIG. 3 illustrates the method of interconnecting various size electrical component conductors such as conductors 34, 35 and 36 in accordance with the present invention. FIG. 3 also illustrates the mounting of a component 37 such as a transistor onto the electrical connector apparatus 10. Electrical component conductors 34, 35 and 36 are inserted through the openings 14 in the front panel 12 and are connected together by contact springs 24 and 26 in contact cavity 22 located in row 19*a*. It should be noted that these component conductors 34, 35 and 36 are different sizes and may represent different types of components. For example, 35 may be a conductor on a resistor, 34 may be an end of a regular wire, and 36 may be a conductor for a capacitor. It should be noted that these three interconnections are insulated from other interconnections in other contact cavities 22 which may be in adjacent columns and rows.

Also illustrated in FIG. 3 is a component base 37 containing a transistor 38 plugged into a transistor socket 39. The component base 37 has three connector pins 40, two of which are shown in FIG. 3. The connector pins 40 connect the transistor 38 into the circuit when inserted into the contact cavities located in rows 19*e* and 19*f*. Of course, other interconnections can be made to the transistor 38 by the remaining pin not shown and, of course, the cavities in which the transistor is plugged may accommodate additional connections. The purpose of illustrating the component 37 plugged into the board is simply to show that a variety of other electrical components having base structures may be accommodated by the connector apparatus 10.

As was stated previously, the size of the holes and their alignment in columns and rows can be varied to accommodate different types of components and there are enough spaces on the board or the board can be made large enough to accommodate almost any type of component and/or electrical conductor which is to be attached thereto.

The electrical connector apparatus which has been described is extremely versatile and can interconnect almost any electrical component or wire without requiring special sockets, plugs, pins or without modifying the conductors which are inserted therein. An insulating work surface is provided which accommodates a variable group of contact cavities with each cavity being made of insulating material and designed to accommodate the two coil contact springs which are arranged in parallel planes adjacent to each other and which accept a variety of components. The adjacent surfaces of the parallel contact springs provide electrical conductors that resist the diametric mass of the electrical component conductors which are inserted therebetween thereby providing a means of securing multiple inserted conductors of variable diameter to each contact cavity. The openings, of course, are arranged in a vertical plane so as to intersect the two coil contact springs at a point which will satisfy optimum electrical, mechanical and reliability characteristics. The contact cavity is designed to distribute the forces of the springs expansion in such a manner as to provide optimum insertion force, withholding force and a contact surface which will insure minimum insertion resistance for a wide range of electrical component conductor diameters. The force distribution also ensures minimum wear on the conductors or the conductors of the device or component which is repeatedly inserted into the cavity in order to make connections thereto. When the electrical conductor is inserted into the cavity both contact springs are forced to expand in the direction perpendicular to the parallel plane with the lateral spring expansion being confined to the immediate vicinity of the inserted electrical conductor because of the lateral spring expansion baffles which are molded and are part of each contact cavity. Because of the particular electrical connector apparatus design, varying diameter electrical conductors can easily be inserted in adjacent openings without degrading the spring tension placed on the smallest component conductor connected to a common junction.

Since other changes and modifications varied to fit particular operating requirements and environments will be apparent to those skilled in the art, the invention is not considered limited to the examples chosen for purposes of illustration, and covers all changes and modifications which do not constitute a departure from the true spirit and scope of this invention.

What is claimed is:

1. An electrical connector apparatus for the interconnection of electrical conductors and components having conductive leads comprising:

a panel of insulating material having a plurality of openings therein adapted to receive electrical conductors, a plurality of cavities positioned on said panel opposite said openings, each of said cavities being accessible to electrical conductors through a different set of said openings, each of said cavities having adjacent coiled contact springs positioned therein which are adapted to receive and hold said electrical conductors inserted into said cavities through said openings, spring expansion baffles positioned along opposite walls of said cavities defining lateral expansion areas for said springs within said cavities, said electrical conductors being held in frictional engagement between said springs, the lateral deflection of said springs within said lateral expansion areas being determined by the size of said electrical conductors.

2. The connector apparatus as claimed in claim 1 in which each set of openings is an aligned group of openings having a cavity aligned therewith, said group of openings providing access to said aligned cavity.

3. The connector apparatus as claimed in claim 1 or 2, in which said cavities are formed in insulating material.

* * * * *